US006002908A

United States Patent [19]

Hayashi et al.

[11] Patent Number: 6,002,908

[45] Date of Patent: Dec. 14, 1999

[54] DRIVE DEVICE, AND FUSING DEVICE AND TRANSFER DEVICE INCLUDING SAID DRIVE DEVICE

[75] Inventors: Hideji Hayashi, Okazaki; Satoru Yoneda; Toshio Sakata, both of Toyohashi; Tetsuya Yamada; Takashi Yamada, both of Aichi-Ken; Yoshifumi Kosagi, Toyokawa, all of Japan

[73] Assignee: Minolta Co., Ltd., Osaka, Japan

[21] Appl. No.: 09/179,937

[22] Filed: Oct. 28, 1998

[30] Foreign Application Priority Data

Oct. 29, 1997 [JP] Japan ..... 9-298306

[51] Int. Cl.[6] ..... G03G 15/20; G03G 15/16

[52] U.S. Cl. ..... 399/312; 397/329; 198/840

[58] Field of Search ..... 359/329, 165, 359/303, 312; 198/835, 840, 843; 226/190

[56] References Cited

U.S. PATENT DOCUMENTS

| | | | |
|---|---|---|---|
| 2,567,494 | 9/1951 | Nicholoy | 198/840 |
| 2,828,854 | 4/1958 | Cibula, Sr. | 198/835 |
| 4,286,706 | 9/1981 | Castelli et al. | 198/806 |
| 5,235,395 | 8/1993 | Ishiwata | 399/329 |
| 5,740,511 | 4/1998 | Todome | 399/303 |

FOREIGN PATENT DOCUMENTS 06318001 11/1994 Japan .

*Primary Examiner*—Joan Pendegrass
*Attorney, Agent, or Firm*—McDermott, Will & Emery

[57] ABSTRACT

The present invention provides a drive device having slip stoppers that can reliably prevent skewed movement of or damage to a belt.

The drive device pertaining to the present invention has a roller, a drive roller, a belt that is suspended and moves over these rollers, and slip stoppers that are mounted to the roller and prevent the belt from moving in a skewed fashion. The slip stopper comprises a base into which the roller is inserted, a first wall that is located on the edge of the base that faces the belt and that is essentially perpendicular to the inner surface of the base and a second wall that extends outward continuously from the first wall and is tilted toward the other edge of the base.

14 Claims, 7 Drawing Sheets

DRIVE DEVICE, AND FUSING DEVICE AND TRANSFER DEVICE INCLUDING SAID DRIVE DEVICE

The application is based on application(s) No. 09-298306 filed in Japan, the content of which is hereby incorporated by reference.

BACKGROUND OF THE INVENTION

1. Field of the Invention

The present invention pertains to (i) a drive device having slip stoppers that reliably prevent skewed movement of or damage to a belt, and more particularly, to a fusing device, used in an image forming apparatus such as a printer or a copying machine using the electrophotographic method, which has slip stoppers that prevent skewed movement of the fusing belt used for the heat-pressure fusing, or (ii) a transfer device, used in an image forming apparatus such as a printer or a copying machine using the electrophotographic method, that has slip stoppers that prevent skewed movement of the transfer belt.

2. Description of the Related Art

In a drive device that drives a belt, skewed movement of the belt easily occurs due to misalignment of the drive axes that drive the belt. Skewed movement of a belt may cause various problems in the belt drive device.

For example, image forming apparatuses such as printers or copying machines using the electrophotographic process are equipped with a fusing device that fuses the unfused toner image held onto a sheet, i.e., a recording medium. While various fusing methods are available, the heat-pressure fusing method is generally used. The fusing device using this heat-pressure method may be of a belt type or a heat roller type depending on the specific form of the rotatable member. Japanese Laid-Open Patent Application Hei 6-318001 discloses one example of a fusing device of the belt type.

A belt-type fusing device such as the one disclosed in said patent application (Hei 6-318001) has a drive roller and a heat roller having a built-in heat source, as well as a fusing belt that moves while being suspended over the pair of rollers, and the fusing belt is heated to a certain temperature by means of the heat from the heat roller. In this belt-type fusing device, the unfused toner on the sheet is conveyed such that it faces the fusing belt, and therefore, it is preheated by means of the radiating heat from the fusing belt before it reaches the nipping area where the fusing belt and the pressure roller are in pressure contact. As a result, the temperature at the nipping area may be set lower in a belt-type fusing device than in the roller fusing method, which makes fusing devices of this type more compatible with the demand for reduced energy consumption and quick printing. Further, since the toner is not melted to an unnecessary extent because the nipping area temperature can be set relatively low, the advantage is obtained that the amount of the releasing agent (such as silicone oil) that is used to prevent the transfer of the toner to the fusing belt, i.e., the offset phenomenon, may be reduced to one tenth of what is needed in the roller fusing method.

On the other hand, however, in belt-type fusing devices, if the fusing belt that is suspended between the rollers moves in a skewed fashion, the fusing belt may become damaged, or image noise may occur in the fused image.

The same problem exists in the transfer device that transfers the developed toner image held on the photoreceptor, which is the image carrier, in image forming apparatuses such as printers or copying machines using the electrophotographic method. In other words, the transfer device transfers the toner image from the photoreceptor to the transfer belt surface or the surface of a recording medium such as copy paper that is held on the transfer belt. When this is done, if the transfer belt moves in a skewed fashion, the image is transferred to a position that is offset from the initial targeted position, making accurate transfer impossible, or the transfer belt comes into contact with various components of the image forming apparatus, causing damage to the transfer belt.

OBJECTS AND SUMMARY

The present invention was made in order to resolve these problems. Its object is to provide a drive device that prevents skewed movement of a belt.

Another object of the present invention is to provide a fusing device equipped with slip stoppers that can reliably prevent skewed movement of or damage to the fusing belt and that prevents the occurrence of image noise.

Yet another object of the present invention is to provide a transfer device equipped with slip stoppers that can reliably prevent skewed movement of or damage to the transfer belt and that prevents the occurrence of image noise.

BRIEF DESCRIPTION OF THE DRAWINGS

These and other objects and features of the present invention will become apparent from the following description of a preferred embodiment thereof taken in conjunction with the accompanying drawings, in which.

In the following description, like parts are designed by like reference numbers throughout the several drawings.

DETAILED DESCRIPTION OF THE PREFERRED EMBODIMENT

An embodiment pertaining to the drive device of the present invention, the fusing device including said drive device and an image forming apparatus including said fusing device is explained below with reference to the drawings.

Construction of the Printer of the Embodiment

Figure 1:
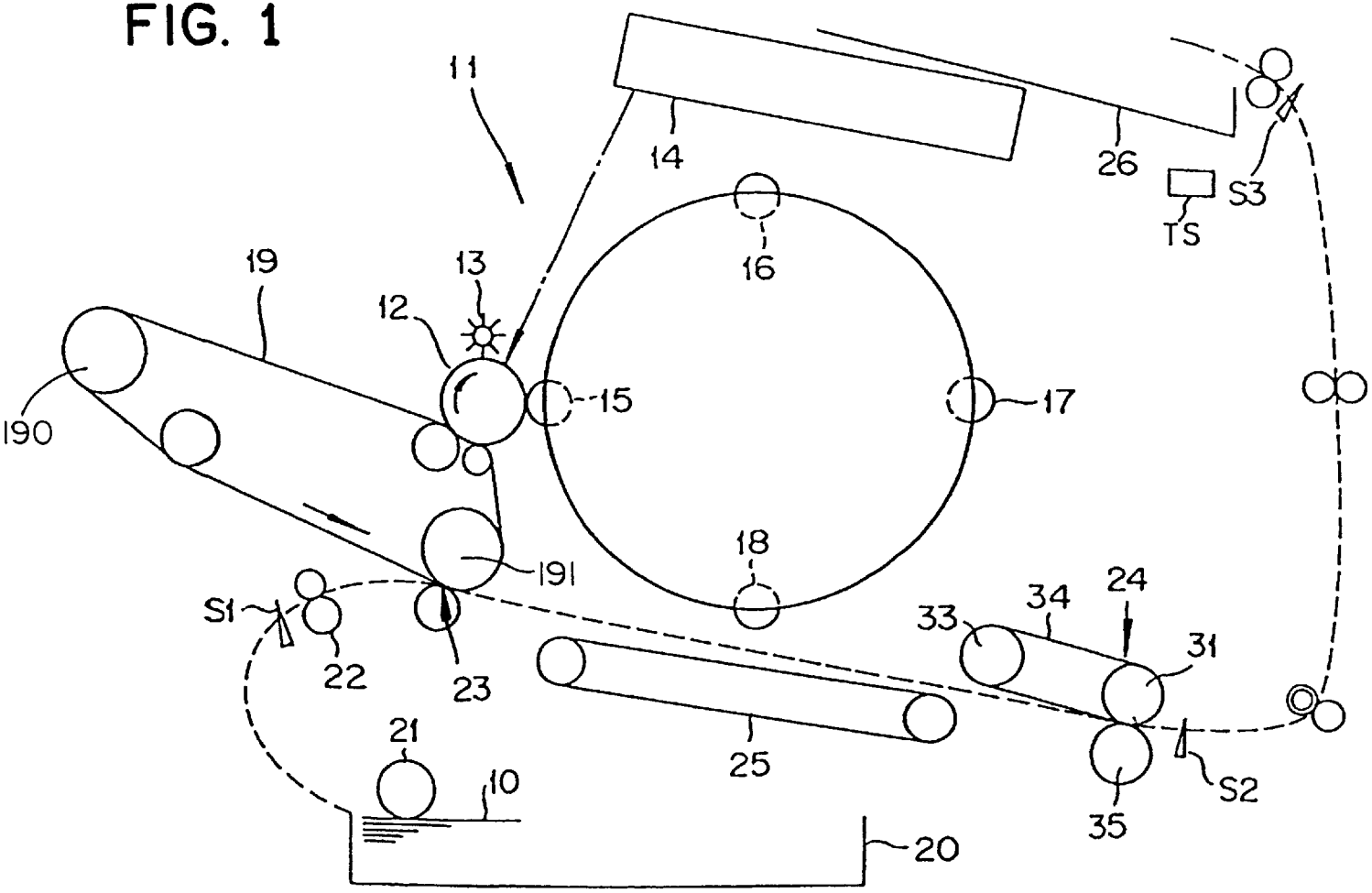
FIG. 1 shows the basic construction of a color printer using the electrophotographic method, in which the drive device and fusing device pertaining to the present invention are incorporated.

FIG. 1 shows the basic construction of a color printer using the electrophotographic method, in which the fusing device pertaining to the present invention is incorporated.

The printer 11 shows in FIG. 1 has a photoreceptor drum 12 that comprises an image carrier, and a laser beam generator 14. Around the photoreceptor drum 12 that rotates in the direction of the arrow are located a charger 13 that charges the surface of the photoreceptor drum 12, a developing device comprising first through fourth developing units 15, 16, 17 and 18, a transfer belt 19, a cleaning device not shown in the drawing that removes the remaining toner on the photoreceptor drum 12, and an internal temperature detecting sensor TS that detects the temperature inside the printer 11. The laser beam generator 14 modulates the semiconductor laser in response to the levels of the image signals sent from a computer not shown in the drawing. The laser beam is irradiated onto the area on the photoreceptor drum 12 between the charger 13 and the developing device via a polygon mirror, an f-θ lens and a reflecting mirror, all of which are not shown in the drawing. The electrostatic latent image formed on the photoreceptor drum 12 by means of the irradiation of the laser beam is developed into a yellow toner image by the first developing unit 15. This yellow toner image is held onto the transfer belt 19 that rotates in the direction of the arrow. The electrostatic latent image formed on the photoreceptor drum 12 is then developed into a magenta toner image by means of the second developing unit 16, and the magenta toner image is overlaid onto the yellow toner image on the transfer belt 19. The electrostatic latent image formed on the photoreceptor drum 12 is further developed into a cyan toner image by means of the third developing unit 17 in the same way, and by overlaying this cyan toner image onto the toner images on the transfer belt 19, a color toner image is created. The fourth developing unit 18 houses black toner. When monochrome printing is designated, the electrostatic latent image on the photoreceptor drum 12 is developed into a black toner image using the fourth developing unit 18.

On the other hand, the paper supply cassette 20 that is detachably attached to the printer main body houses a stack of multiple sheets 10. The sheets 10 are supplied one by one into the printer by the paper supply roller 21 and are conveyed to the transfer area 23 by the timing roller 22 that is synchronized with the toner image. The color toner image on the transfer belt 19 is transferred to the sheet 10 in this transfer area 23. The sheet 10 after image transfer is separated from the transfer belt 19, and is conveyed to the fusing device 24 by means of the conveyance belt 25. The unfused toner transferred onto the sheet 10 is fused and fixed by the fusing device 24, and the sheet 10 onto which the toner is fixed is ejected onto the eject paper tray 26. The fusing device 24 of this embodiment uses the belt method. Its construction will be described below.

When the image transfer onto the sheet 10 is completed, the photoreceptor drum 12 is rid of the remaining toner by the cleaning device and rid of the remaining charge by the eraser. After that, the photoreceptor drum 12 is charged again by the charger 13 and a latent image is formed by means of the laser beam. The latent image is then developed by means of the developing units 15 through 18.

Multiple sensors S1, S2 and S3 that detect the sheet 10 are located on the sheet conveyance path. Based on the signals indicating the detection of the top edge and/or the rear edge of the sheet 10 by the sensors S1, S2 and S3, the control timing of the various members of the printer is determined.

Construction of the Drive Device and the Fusing Device

Figure 2:
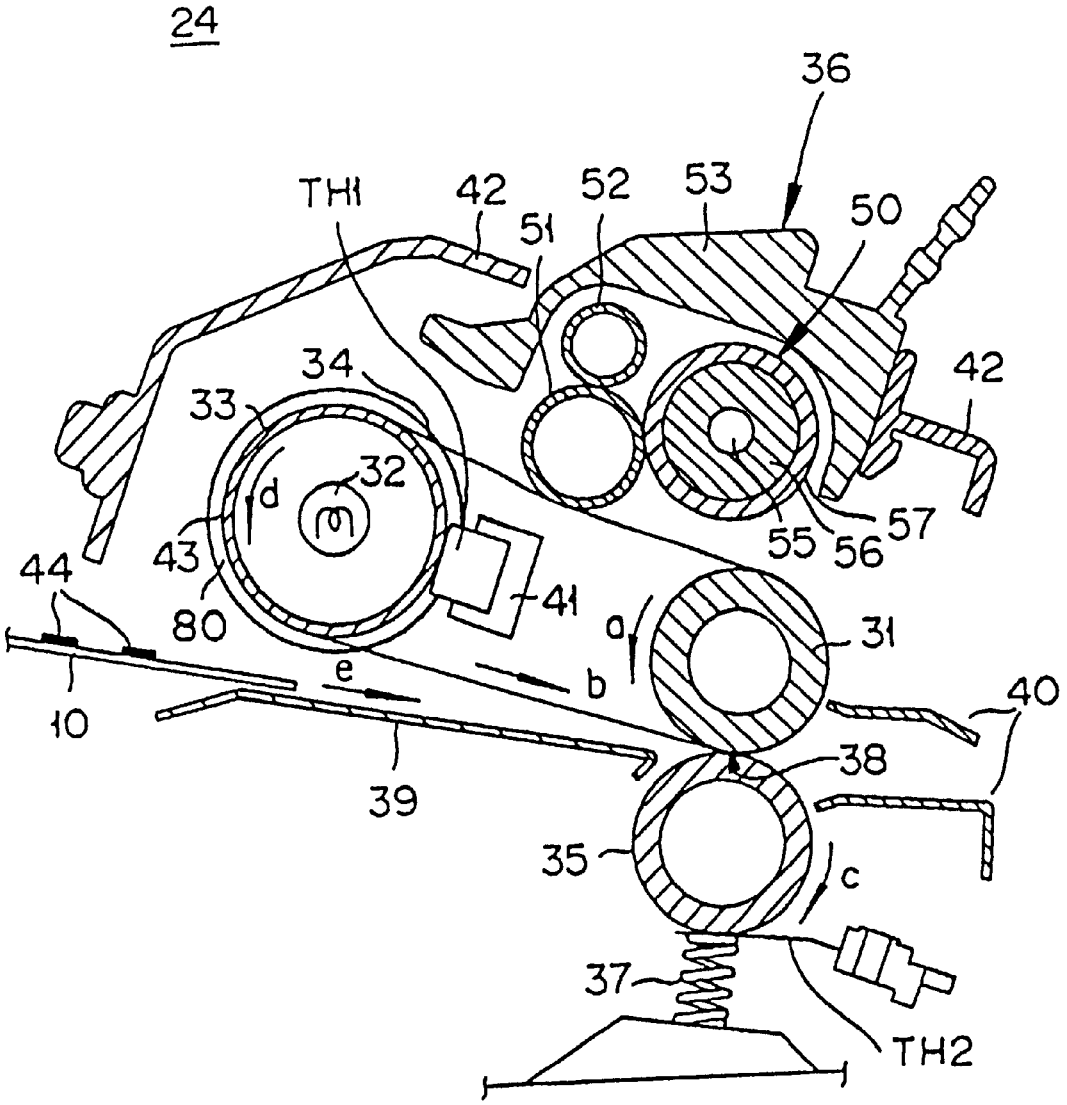
FIG. 2 is a cross-sectional view showing the details of the belt-type fusing device shown in FIG. 1.

FIG. 2 is a cross-sectional view showing the drive device and the fusing device using the belt method shown in FIG. 1.

The fusing device 24 has a drive roller 31 mounted such that it may rotate in the direction of the arrow (a), a heat roller 33 that has a built-in halogen heater lamp 32 that comprises the heat source, a fusing belt 34 that is suspended over and moves between the drive roller 31 and the heat roller 33, a pressure roller 35 that is in pressure contact with the drive roller 31 via the fusing belt 34, and an oil application unit 36 that applies a releasing agent onto the surface of the fusing belt 34 to prevent toner offsetting. To either end of the axis of at least one of the rollers 31 and 33 over which the fusing belt 34 is suspended (the heat roller 33 in the example shown in the drawing) is mounted a slip stopper 80 that prevents skewed movement or zig-zag movement of the fusing belt 34, to stabilize its movement. The construction of the slip stopper 80 is described below. The fusing belt 34, the pair of rollers 31 and 33 and the slip stoppers 80 comprise the drive device. For the releasing agent, silicone oil is used.

The fusing belt 34 is a thin and preferably seamless belt. It is a continuous belt comprising a belt base made of carbon steel, stainless steel, nickel or heat-resistant resin, with its surface coated with silicone rubber having a good affinity with silicone oil, such that a heat-resistant releasing layer is formed that has good toner releasing and heat-resistant characteristics. The thickness of the belt base is approximately 40 $\mu$m, and the thickness of the rubber coating is approximately 200 $\mu$m. It is also acceptable if 4-ethylene fluoride resin is used for the heat-resistant releasing layer.

Fixed to one end of the drive roller 31 is a drive gear not shown in the drawing. The drive roller 31 is rotated in the direction of the arrow by a drive source such as a motor that is connected to this drive gear but is not shown in the drawing. The drive roller 31 is in contact with the back surface of the fusing belt 34 and moves it in the direction of the arrow (b). The surface of the drive roller 31 is coated with a material having a high friction coefficient (silicone rubber, for example) in order to ensure reliable movement of the fusing belt 34, so that slipping will not occur between the roller 31 and the fusing belt 34. In order to secure a prescribed nipping width, the material coating the surface of the drive roller 31 is preferably a material having a relatively low hardness level (silicone sponge, for example).

The heat roller 33 comprises a hollow metal roller, and a halogen heater lamp 32 is located on its axis. A resistant heat generator on an electromagnetic heating device may also be used for the heat source. In order to efficiently provide heat to the fusing belt 34, it is also preferred that the heat roller 33 be made of aluminum or copper, materials having a high heat conduction characteristic.

The pressure roller 35 comprises a metal pipe coated with silicone rubber or teflon, and is in pressure contact with the drive roller 31 via the fusing belt 34 due to the spring force of a spring 37. When the fusing belt 34 rotates in the direction of the arrow (b) as the drive roller 31 rotates, the pressure roller 35 is driven in the direction of the arrow (c) due to its friction contact with the fusing belt 34. The relationship between the surface hardness of the drive roller 31 and the pressure roller 35 is set such that the surface hardness of the pressure roller 35 ≧ that of the drive roller 31'. This is due to the reason described below. In order to smoothly eject a sheet 10 from the nipping area 38 between the pressure roller 35 and the fusing belt 34 after the toner is fused, the sheet 10 should be conveyed after separation from the surface of the drive roller 31 in the direction in which it is traveling at the moment of separation, or along a plane parallel to the axes of the rollers. For this to occur, the pressure roller 35 should be in contact with the drive roller 31 in such a fashion that it is presses slightly into the drive roller 31 via the fusing belt 34.

In order to guide the sheet 10 holding unfused toner to the nipping area 38 without allowing it to touch the fusing belt 34, a guide plate 39 is located under the fusing belt 34. A eject paper guide 40 is located downstream from the nipping area 38.

A first temperature sensor TH1 that detects the temperature of the heat roller 33 is located inside the fusing belt 34, and a second temperature sensor TH2 that detects the temperature of the pressure roller 35 is located next to the pressure roller 35. The first and second temperature sensors TH1 and TH2 comprise thermistors, for example. The sensors are in contact with the surfaces of the rollers 33 and 35, respectively, and detect the roller surface temperatures. The first temperature sensor TH1 is supported by a support 41 positioned relative to the rotational axis of the heat roller 33 such that its relative positional relationship, or its contact, with the heat roller 33 is maintained in a certain fashion.

The printer 11 of this embodiment detects the surface temperature of the pressure roller 35 that does not have a heating source by means of the second temperature sensor TH2, and based on the surface temperature of the pressure roller 35, the controlled temperature of the halogen heater lamp 32 is determined and the timing of the commencement of printing is controlled. In order to adjust the temperature of the halogen heater lamp 32 to the determined controlled temperature, the flow of electric current to the halogen heater lamp 32 is turned ON and OFF, while the surface temperature of the heat roller 33 is detected by means of the first temperature sensor TH1. It is acceptable if a thermostat is located on the support 41 as a safety mechanism, to cut off the power supply to the halogen heater lamp 32 if an abnormally high temperature is reached.

A construction is also possible in which the first temperature sensor TH1 is placed in contact with the surface area of the fusing belt 34 that is in contact with the heat roller 33. In such a construction, because the temperature of the surface of the fusing belt 34 that comes into direct contact with the toner is directly measured, highly accurate temperature adjustment can be performed, but on the other hand, the surface of fusing belt 34 becomes scraped off and damaged due to the contact with the first temperature sensor TH1. If the outer surface of the fusing belt 34 is damaged, image noise such as oil streaks occurs, leading to the problems of image deterioration and shortened belt life. Therefore, in this embodiment, the construction in which the first temperature sensor TH1 is in contact with the heat roller 33 is used. Together with this construction, the surface of the heat roller 33 is coated with a material having a low friction coefficient (fluorocarbon resin, for example). The further advantage is obtained that, if it is located inside the fusing belt 34, the first temperature sensor TH1 is not affected by the air flow that exists around the fusing belt 34.

The oil application unit 36 is located above the fusing belt 34, and comprises an oil application roller 50 containing oil that is applied to the fusing belt 34, an oil transfer roller 51 that is in contact with the surface of the oil application roller 50 and that applies the oil provided from the oil application roller 50 to the outer surface of the fusing belt 34, a cleaning roller 52 that is in contact with the surface of the oil transfer roller 51 and removes the paper particles and toner adhering to the oil transfer roller 51, and a holder 53 that rotatably supports these rollers 50, 51 and 52. The oil transfer roller 51 is in pressure contact with the fusing belt 34 at the area in which the fusing belt 34 moves from the drive roller 31 toward the heat roller 33, applying an appropriate level of tension to the fusing belt 34. This stabilizes both the movement of the fusing belt 34 and the application of oil to the fusing belt 34 from the oil transfer roller 51.

The oil application roller 50 has a multi-layered construction, and comprises an oil holding layer 56 that is located on the surface of a metal core 55 and holds the oil, and a surface layer 57 that is located on the surface of the oil holding layer 56. The oil transfer roller 51 comprises a metal core and a silicone rubber coating over the metal core that has a high affinity with silicone oil, and the cleaning roller 52 comprises a metal core and a felt coating over the metal core. The surface of the oil transfer roller 51 is rougher than the surface of the fusing belt 34, such that dirt and other particles on the fusing belt 34 adhere to the oil transfer roller 51, while the surface of the cleaning roller 52 has a lower releasing characteristic that the surface of the oil transfer roller 51, so that the dirt, etc., becomes adhered to it from the oil transfer roller 51.

The oil application unit 36 is constructed such that it may be detachably mounted to the frame 42 of the fusing device 24. When the oil contained inside the oil application roller 50 is consumed, the used-up oil application unit 36 is removed from the frame 42 and replaced with a new oil application unit 36. It is also acceptable, incidentally, if a cleaning pad is in contact with the surface of the oil transfer roller 51 instead of the cleaning roller 52, or if the oil application roller 50 is in direct pressure contact with the fusing belt 34.

The operations of the fusing device 24 will now be explained.

When the motor is driven, the drive roller 31 rotates in the direction of the arrow (a) and the fusing belt 34 moves in the direction of the arrow (b). As the fusing belt 34 moves, the heat roller 33 is driven to rotate in the direction of the arrow (d) while the pressure roller 35 is driven to rotate in the direction of the arrow (c). After oil is applied at the upstream area of the heat roller 33, the moving fusing belt 34 is heated to a prescribed temperature by means of the heat from the halogen heater lamp 32 at the area at which it is in contact with the heat roller 33 (heating area 43). It then moves above the guide plate 39 and proceeds to the nipping area 38 at which it is in contact with the pressure roller 35.

On the other hand, the sheet 10 holding unfused toner 44 on the side that comes into contact with the fusing belt 34 is conveyed to the nipping area 38 while being guided by the guide plate 39 in the direction of the arrow (e). During this time, the sheet 10 and the unfused toner 44 are heated (preheated) by the heat from the fusing belt 34, which they face across a prescribed distance. This preheating softens in advance the unfused toner 44 located on the sheet 10.

When the sheet is conveyed further and enters the nipping area 38, the sheet 10 is sufficiently heated by the heat from the fusing belt 34 with which it is now in contact, and it is conveyed through the nipping area 38 while being pressed between the pressure roller 35 and the drive roller 31. Through this operation, the unfused toner 44 on the sheet 10 becomes sufficiently heated and melts, and is fixed onto the sheet 10 due to pressurization. The transfer of toner to the fusing belt 34, or offsetting, is reduced due to the oil applied on the surface of the fusing belt 34.

The sheet 10 that has passed through the nipping area 38 automatically separates from the fusing belt 34 and is conveyed to the eject paper tray 26 (see FIG. 1). To the fusing belt 34 whose heat has been taken due to its contact with the sheet 10 is added heat from the halogen heater lamp 32 under prescribed temperature control.

In this fusing device 24, the busing belt 34 is heated after oil is applied to it, and therefore, the temperature of the fusing belt 34 is stable and toner bonding is performed well. In addition, because the oil transfer roller 51 gives tension to the fusing belt 34, uneven movement of the fusing belt 34 is reduced, and consequently, as well as because of the effect of the slipping stoppers 80, the fusing belt 34 moves in a smooth and stable fashion and the belt life is also extended.

Further, because the contamination of paper particles and toner on the fusing belt 34 adheres to the oil transfer roller 51 which is in contact with the fusing belt 34, and then onto the cleaning roller 52, its adherence to the oil application roller 51 is reduced. As a result, oil is provided to the oil transfer roller 51 from the oil application roller 50 in a smooth and stable fashion, leading to uniform and stable application of oil on the fusing belt 34 from the oil transfer roller 51. Therefore, the fusing belt 34 can be cleaned while offsetting is reliably prevented, resulting in high-quality bonded image.

Construction of Slip Stopper 80

The construction of the slip stopper 80 will now be explained in detail.

Figure 3:
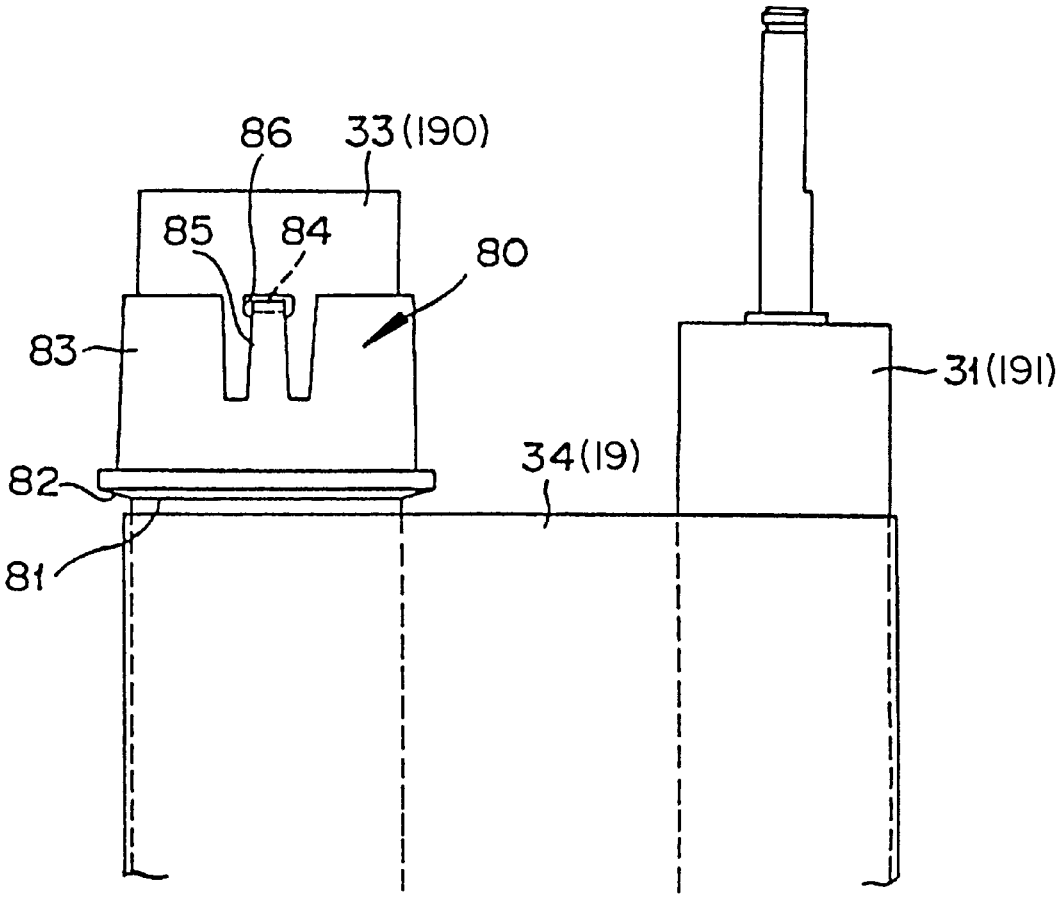
FIG. 3 is a plan view showing the heat roller and the drive roller over which the fusing belt is suspended, and a slip stopper mounted to the heat roller.
Figure 4:
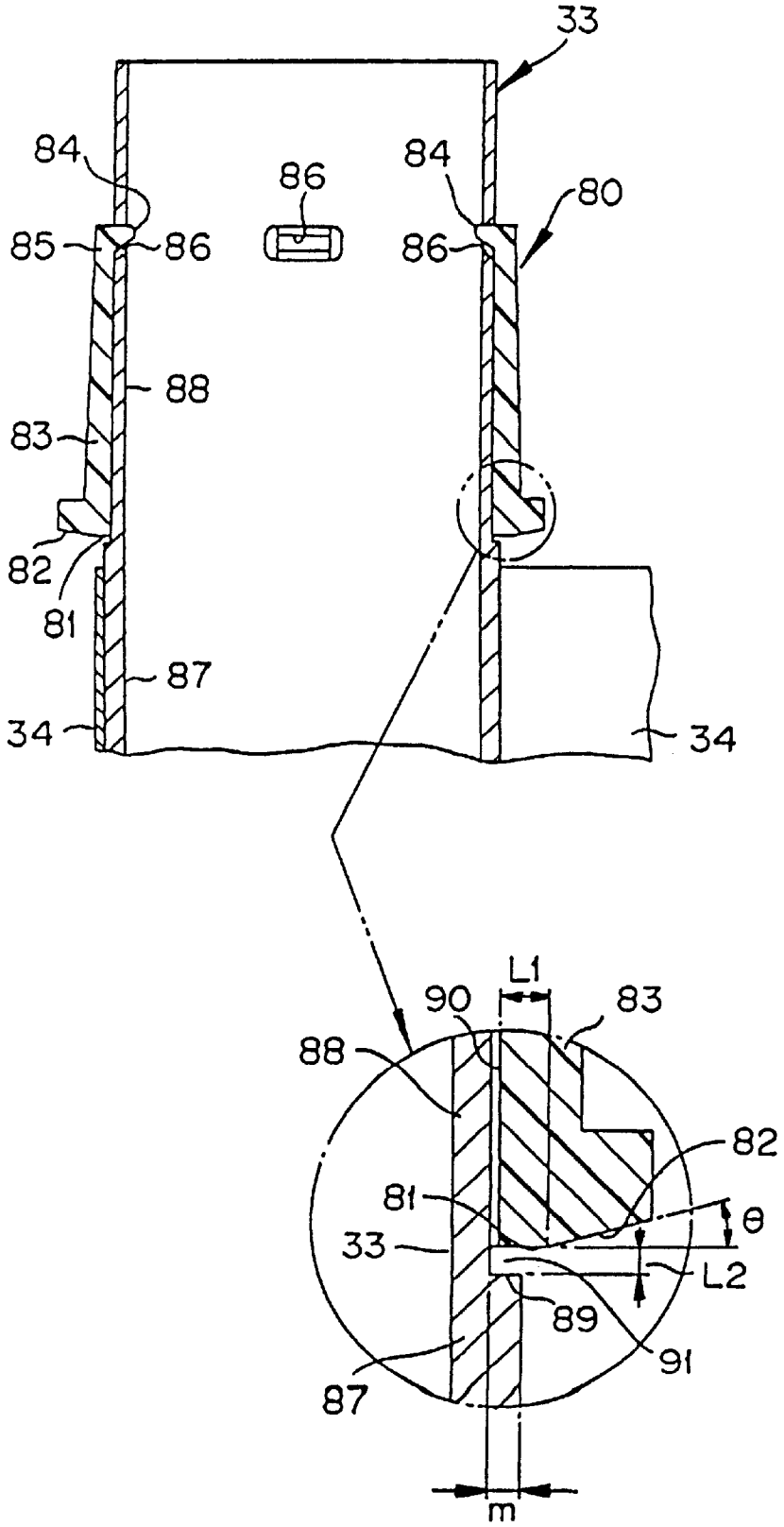
FIG. 4 is a cross-sectional view of the important components of FIG. 3.
Figure 5A:
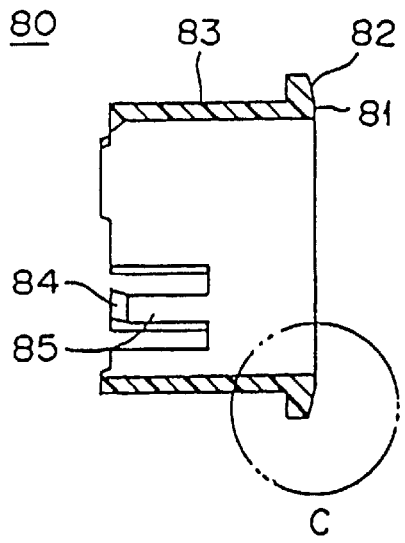
FIGS. 5(A) through (C) are a cross-sectional view, a side elevation, and an enlargement of important components of the slip stopper, respectively.
Figure 5B:
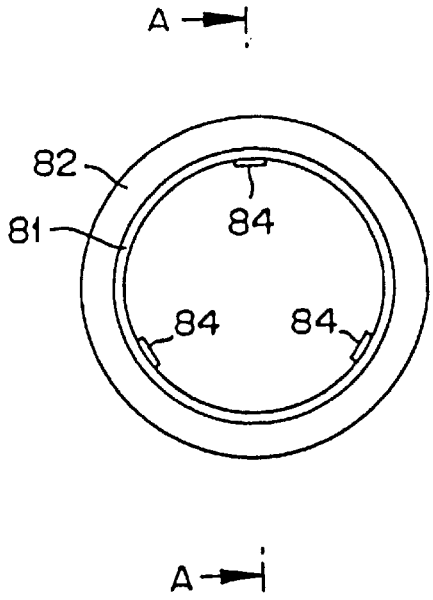
Figure 5C:
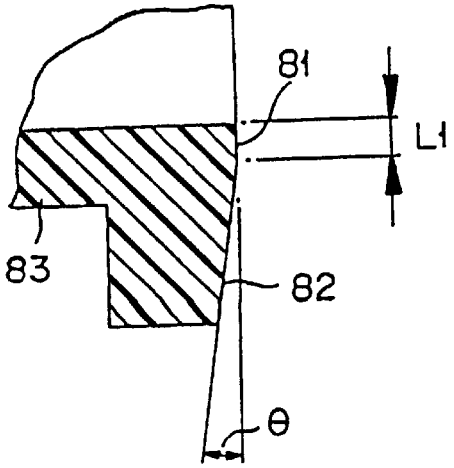

FIG. 3 is a plan view showing the heat roller 33 and the drive roller 31 over which the fusing belt 34 is suspended, as well as the slip stopper 80 mounted to the heat roller 33. FIG. 4 is a cross-sectional view of important components shown in FIG. 3. FIGS. 5(A) through (C) are a cross-sectional view, a side elevation and an enlargement of important components of the slip stopper 80, respectively.

While FIGS. 3 and 4 show only one end of the heat roller 33, a slip stopper 80 is mounted to either end of the heat roller 33 as mentioned above. In the explanation below, with the slip stopper 80 mounted on the heat roller 33, the side of the slip stopper 80 that faces the fusing belt 34 is deemed the inner side of the stopper and the opposite side is deemed the outer side for the sake of convenience.

As shown in FIGS. 5(A) through (C), the slip stopper 80 has an essentially cylindrical configuration. It comprises a cylindrical base 83 in which the heat roller 33 is inserted, a first wall 81 located on the edge of the base 83 that faces the fusing belt 34 (the inner edge) and a second wall 82 that extends continuously from the first edge 81. The first wall 81 is formed such that it is essentially perpendicular to the inner surface of the base 83. The second wall 82 extends continuously from the first wall 81 outward and is tilted toward the other edge of the base 83 (the outer edge).

Elastic engagement arms 85 that have an engagement claw 84 on their tips are formed in the base 83. Three engagement arms are formed in the example shown in the drawing. The slip stopper 80 is fixed onto the heat roller 33 by means of the engagement claws 84 of the engagement arms 85 engaging with the holes 86 formed on the heat roller 33, as shown in FIG. 4, so that the slip stopper 80 rotates together with the heat roller 33. Since the fusing belt 34 rotates with little slipping relative to the heat roller 33, the edge of the fusing belt 34 moves little relative to the surface of the slip stopper 80. This reduces the resistance or load to the movement of the fusing belt 34 and increases the stability of said movement.

The slip stopper 80 is formed of a material that does not include fiber additives. It is furthermore preferred that it be heat-resistant (to 200° C., for example) and durable (with a useful life up to 1,000 hours, for example). The slip stopper 80 is specifically formed of polyimide resin.

With reference to FIG. 4, a step 89 is formed on the heat roller 33 between the large-diameter member 87 on which the fusing belt 34 moves and the small-diameter member 88 to which the slip stopper 80 is mounted. This step 89 is formed in order to prevent the fusing belt 34 from entering the gap between the base 83 of the slip stopper 80 and the outer surface of the heat roller 33. The step 89 is set to have a height of approximately 0.5 mm (m=0.5 mm).

The first wall 81 is essentially perpendicular to the outer surface of the heat roller 33, and is located so that the edge of the fusing belt 34 may come into contact with it. If the first wall 81 did not exist, the fusing belt 34 would ride up onto the tilted surface that comprises the second wall 82 and become cracked. In order to prevent the occurrence of such a problem, the first wall 81 should protrude from the large-diameter member 87 of the heat roller 33 by more than the thickness of the base of the fusing belt 34. However, if the first wall 81 is larger than necessary, the fusing belt 34 could ride up due to the tilting of the slip stopper 80, which is described below. Therefore, it is preferred that the first wall 81 be as short as possible within the range of its purpose, which is so that the edge of the fusing belt 34 will bump into it. For the purpose of economical mass production of these components, the length of the first wall 81 should be approximately 0.7 mm (L1=0.7 mm).

Figure 6A:
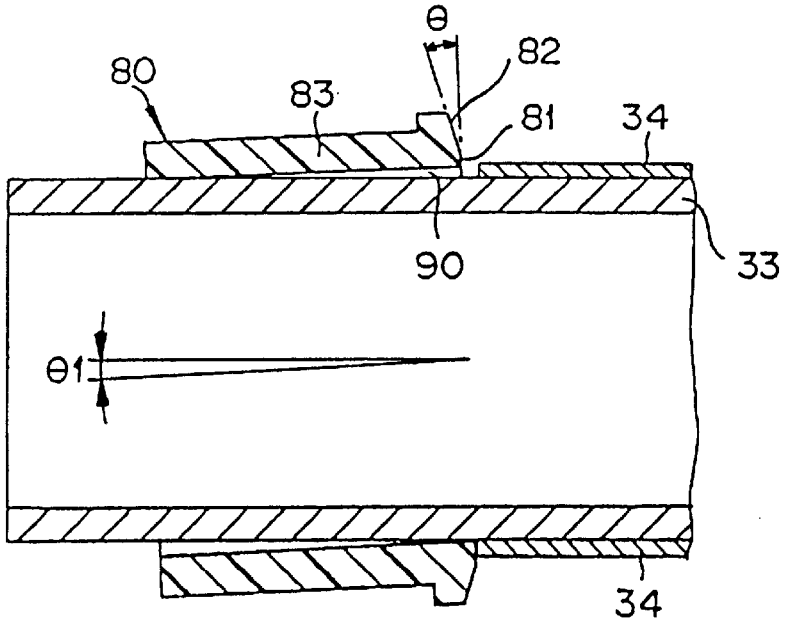
FIGS. 6(A) and (B) are drawings to explain the effect of the second wall of the slip stopper. (A) shows the present embodiment, and (B) shows a comparison example in which the second wall is aligned along a vertical plane identical to that of the first wall.
Figure 6B:
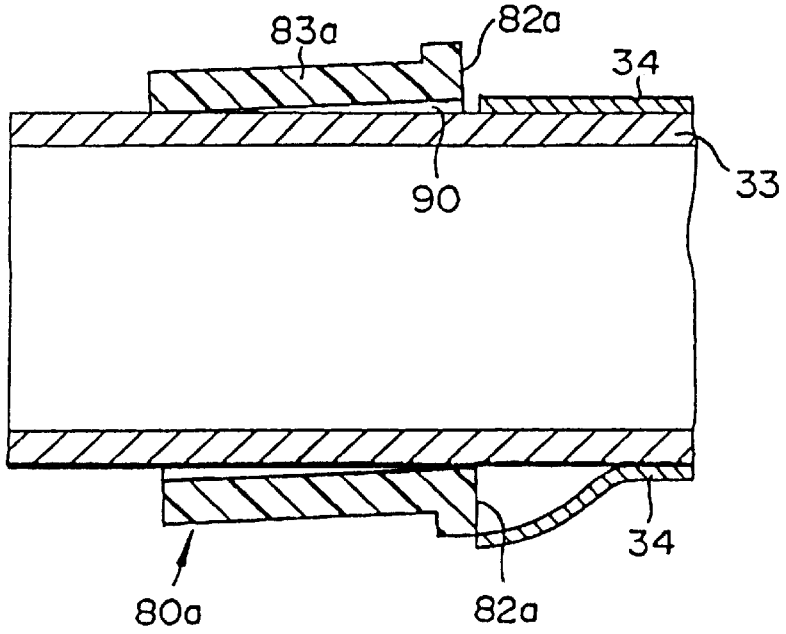

FIGS. 6(A) and 6(B) are drawings to explain the effect of the second wall 82 of the slip stopper 80. FIG. 6(A) shows the current embodiment, while (B) shows a comparison example in which the second wall 82*a* is a vertical wall identical to the first wall 81. The step 89 of the heat roller 33 is omitted from the drawing in FIGS. 6 for purposes of simplification, and the gap 90 between the inner surface of the base 83 or 83*a* of the slip stopper 80 or 80*a* and the outer surface of the heat roller 33 is shown in an exaggerated fashion for easier understanding.

Because the slip stopper 80 or 80*a* is to be inserted over the heat roller 33, it is impossible to eliminate the gap 90 completely. In addition, when economically mass produced, there will be some variation in the dimensions of the slip stopper 80 or 80*a* and the heating roller 33. Therefore, when the edge of the fusing belt 34 comes into contact with the slip stopper 80 or 80*a* when moving, the slip stopper 80 or 80*a* may become tilted relative to the heat roller 33, as shown in FIGS. 6(A) and (B).

Where the second wall 82*a* is vertical, as in the comparison example shown in FIG. 6(B), a part of the second wall 82*a* enters the range of the movement of the fusing belt 34 as the slip stopper 80*a* becomes tilted, and the fusing belt 34 rides up onto the second wall 82*a*. If the fusing belt 34 rides up onto the slip stopper 80*a*, it may begin to move in a skewed fashion or become damaged.

In contrast, in this embodiment shown in FIG. 6(A), the second wall 82 is angled by θ relative to the first wall 81, such that the second wall 82 is farther away from the edge of the fusing belt 34. The tilt angle θ is larger than the tilt angle θ1 of the slip stopper 80 that arises due to the play in the contact between the slip stopper 80 and the heat roller 33. Using the slip stopper 80 having this construction, even if it tilts, a part of the second wall 82 does not enter range of movement of the fusing belt 34, and therefore, the fusing belt 34 does not ride up onto the second wall 82. This prevents the fusing belt 34 from moving in a skewed fashion or being damaged.

Figure 7:
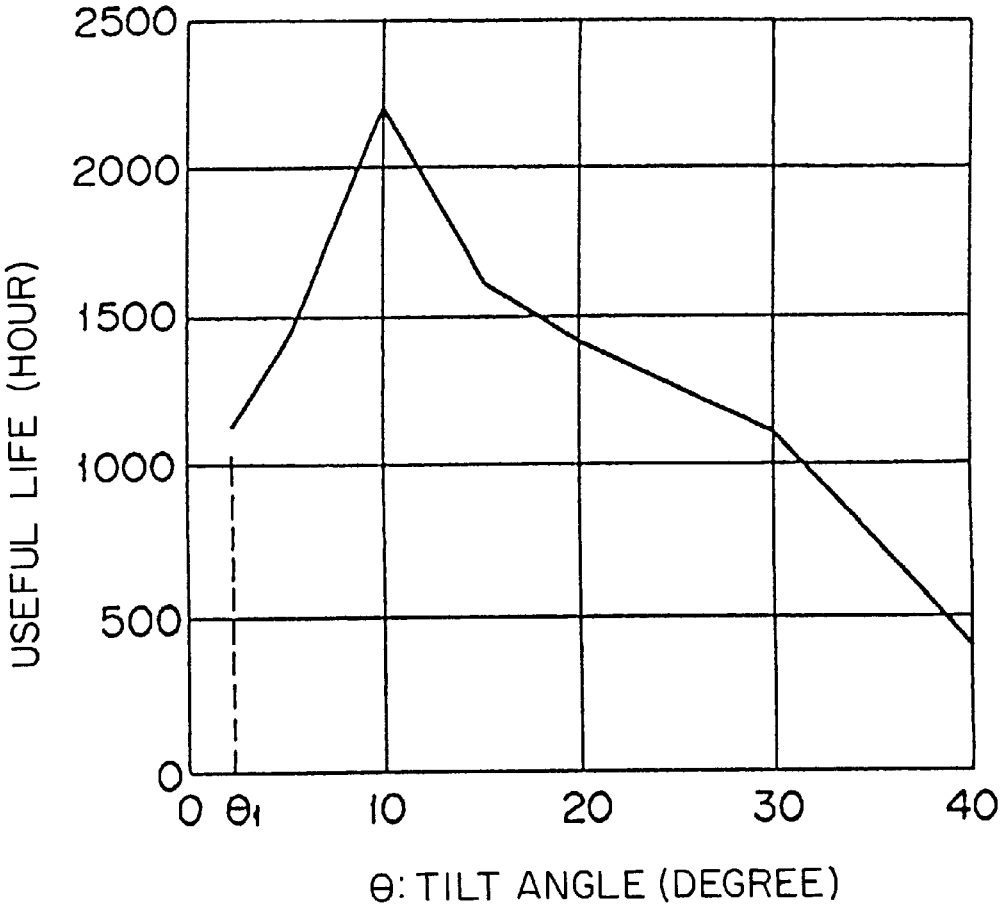
FIG. 7 is a drawing showing the relationship between the tilt angle θ of the fusing belt and its useful life.

FIG. 7 is a drawing showing the relationship between the tilt angle θ of the fusing belt 34 and its useful life.

With the highest obtainable precision in economical mass production, the useful life of the belt was the longest when the tilt angle θ of the second wall 82 was 10°. It was found that in order to extend the belt life to the target of 1,000 hours or longer, it was necessary to meet the condition θ1<tilt angleθ<32°. θ1 here refers to the tilt angle of the slip stopper 80 that arises due to the play described above, and comprises 2°(θ1=2°), for example.

Where the tilt angle θ of the second wall 82 was made too large (θ>35°, for example), when the edge of the fusing belt 34 came into contact with the second wall 82, the second wall 82 could not sufficiently resist the force from the fusing belt 34 that was misaligned from its proper position relative to the axis of the roller, resulting in the fusing belt 34 riding up on the second wall 82 and making the movement of the belt unstable.

With reference to FIG. 4, due to variations in the position of the step 89 and in the dimensions of the slip stopper 80, a gap 91, whose width extends along the axis of the heat roller 33, is formed between the first wall 81 of the slip stopper 80 and the step 89. In order to allow the step 89 and slip stopper 80 to be economically formed or mass produced, the smallest width of the gap 91 would be approximately 0.3 mm (L2=0.3 mm). If the gap 91 is too large, the edge of the fusing belt 34 could fall into or become wedged in this gap 91, resulting in skewed movement of or damage to the fusing belt 34. Therefore, in this embodiment, the gap 91 is set to have a width that does not allow the fusing belt 34 to fall into it, and specifically, is set to be 2 mm or smaller (L2=2 mm).

The slip stopper is formed of resin as described above. If it were made of a material that includes fiber additives, such as PEEK (polyether etherketone), for example, the slip stopper would becomes worn down due to its contact with the fusing belt 34, and the surface of the slip stopper would become exposed to the fibers. These exposed fibers would create resistance or load opposing the movement of the fusing belt 34 and could result in cracking of the fusing belt 34.

In contrast, the slip stopper 80 of this embodiment is formed of a material that does not include fiber additives, such as polyimide resin, for example, the resistance or load opposing the movement of the fusing belt 34 does not increase and cracking of the belt can be prevented.

As explained above, where the present invention is applied in a fusing device, skewed movement of or damage to the fusing belt may be reliably prevented due to the slip stopper having a first wall that is essentially perpendicular to the roller outer surface and a second wall that extends continuously from but is tilted relative to the first wall, and therefore, a fusing device may be provided in which the occurrence of image noise is prevented.

Further, by constructing the slip stopper such that it rotates together with the roller, the edge of the fusing belt moves only slightly relative to the surface of the slip stopper, and therefore, the stability of the movement of the fusing belt may be increased.

Additionally, by having dimensions of the gap between the inner surface of the base of the slip stopper and the roller outer surface and the gap between the first wall of the slip stopper and the step of the roller be such that the fusing belt may not enter them, skewed movement of or damage to the fusing belt may be prevented.

Moreover, by forming the slip stopper of a material that does not include fiber additives, the surface of the slip stopper does not become exposed to fibers, and therefore, the resistance or load opposing the movement of the fusing belt does not increase, which prevents cracking of the belt.

The drive device pertaining to the present invention and the fusing device that includes said drive device were explained above in detail. The drive device, however, may be used as a device to drive a transfer belt, and the same advantages can be obtained in principle.

In other words, the transfer belt 19, the drive roller 191 and the suspension roller 190 shown in FIG. 1 may be constructed in the same manner as the belt 34, the drive roller 31 and the heat roller 33 described above.

Slip stoppers 80 may be mounted to both ends of the suspension roller 190 (denoted by parenthetical in FIG. 3 to illustrate this alternative). By mounting slip stoppers 80 to the drive device for the transfer belt 19 in this way, skewed movement of or damage to the transfer belt may be reliably prevented by means of the first wall that is essentially perpendicular to the roller outer surface and the second wall that extends continuously from but is tilted relative to the first wall, and a transfer device may be provided in which the occurrence of image noise is prevented.

Further, by constructing the slip stopper such that it rotates together with the rollers 191 and 190, the edge of the transfer belt moves only slightly relative to the surface of the slip stopper, which increases the stability of the movement of the transfer belt 19.

Moreover, by making dimensions of the gap between the inner surface of the base of the slip stopper and the roller outer surface and the gap between the first wall of the slip stopper and the step of the roller, whose width runs along the axis of the roller, such that the belt may not enter it, skewed movement of or damage to the belt may be prevented.

In addition, by forming the slip stopper using a material that does not include fiber additives, the surface of the slip stopper does not become exposed to fibers, and therefore, the resistance or load opposing the movement of the transfer belt does not increase, which prevents cracking of the belt.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fusing device including a drive apparatus comprising:

a belt that is suspended an moves over a pair of rollers; and a slip stopper that is mounted to at least one of the rollers, said slip stopper comprising a base into which the roller is inserted, a first wall that is located on the edge of the base that faces the belt and that is essentially perpendicular to the inner surface of the base, and a second wall that extends outward continuously from, but is tilted relative to, the first wall.

2. A fusing device claimed in claim 1, wherein the slip stoppers rotate together wit the roller.

3. A fusing device claimed in claim 1, wherein the tilt angle θ of the tilted second wall meets the condition θ<32°.

4. A fusing device claimed in claim 1, wherein the slip stopper is formed of polyimide.

5. A fusing device claimed in claim 1, wherein one of the rollers incorporates a heater.

6. A fusing device claimed in claim 1, wherein the belt comprises a belt base and silicone rubber or 4-ethylene fluoride resin coating over the surface of the belt base.

7. A fusing device claimed in claim 6, wherein the thickness of the belt base is approximately 40 μm and the thickness of the rubber coating is approximately 200 μm.

8. A fusing device claimed in claim 1, wherein the slip stoppers rotate together with the roller.

9. A fusing device claimed in claim 1, wherein the tilt angle θ of the tilted second wall meets the condition θ<32°.

10. A transfer device including a drive apparatus comprising:

a belt that is suspended an moves over a pair of rollers; and a slip stopper that is mounted to at least one of the rollers, said slip stopper comprising a base into which the roller is inserted, a first wall that is located on the edge of the base that faces the belt and that is essentially perpendicular to the inner surface of the base, and a second wall that extends outward continuously from, but is tilted relative to, the first wall, wherein the slip stopper rotates together with the roller.

11. A transfer device claimed in claim 10, wherein the tilt angle θ of the tilted second wall meets the condition θ<32°.

12. A transfer device claimed in claim 10 wherein the slip stopper is formed of polyimide.

13. A transfer device claimed in claim 10 wherein the belt comprises a belt base and silicon rubber or 4-ethylene fluoride resin coating over the surface of the belt base.

14. A transfer device claimed in claim 13 wherein the thickness of the belt base is approximately 40 micrometers and the thickness of the rubber coating is approximately 200 micrometers.

* * * * *